US005351756A

United States Patent [19]

Minkkinen et al.

[11] Patent Number: 5,351,756

[45] Date of Patent: Oct. 4, 1994

[54] PROCESS FOR THE TREATMENT AND TRANSPORTATION OF A NATURAL GAS FROM A GAS WELL

[75] Inventors: Ari Minkkinen, Saint Nom la Breteche; Joseph Larue, Chambourcy, both of France

[73] Assignee: Institut Francais du Petrole, Rueil Malmaison, France

[21] Appl. No.: 63,912

[22] Filed: May 20, 1993

[30] Foreign Application Priority Data

May 20, 1992 [FR] France ..... 92 06261

[51] Int. Cl.[5] ..... E21B 43/40; E21B 43/16; E21B 43/34

[52] U.S. Cl. ..... 166/267; 166/310; 166/279; 166/302; 166/902

[58] Field of Search ..... 166/310, 902, 250, 267, 166/302, 279

[56] References Cited

U.S. PATENT DOCUMENTS 3,348,614 10/1967 Sinclair et al. ..... 166/45
4,354,553 10/1982 Hensley ..... 166/902
4,416,333 11/1983 Mundhenk et al. ..... 166/250
4,456,067 6/1984 Pinner, Jr. ..... 166/279
4,856,593 8/1989 Matthews et al. ..... 166/310 X

FOREIGN PATENT DOCUMENTS 2657416 7/1991 France .

*Primary Examiner*—Stephen J. Novosad

[57] ABSTRACT

A process for the treatment or processing and transportation of a natural gas from a gas well to a reception and treatment or processing terminal comprises, in a zone in the producing well, contacting the natural gas and a recycled liquid phase containing water and at least one anti-hydrate additive and/or at least one anti-corrosion additive, both of which being at least partly miscible with water and which vaporize in the pure state or as an azeotrope. The resultant additive-containing gaseous phase is cooled to form an uncondensed and a condensate. The condensate containing substantially all of the additive is separated from the uncondensed gas and is recycled to the contact zone in the producing well.

19 Claims, 2 Drawing Sheets

PROCESS FOR THE TREATMENT AND TRANSPORTATION OF A NATURAL GAS FROM A GAS WELL

BACKGROUND OF THE INVENTION

The present invention relates to a process taking place within and in the environment of a condensate gas or natural gas well for the use and regeneration of additives inhibiting hydrates and/or corrosion for the transportation and treatment or processing of the natural gas from said well to a reception and treatment or processing terminal.

In the case of the production of natural gas in a difficult area, i.e. in the ocean or on land in remote or relatively inaccessible areas, producing companies attempt to transport the gas, which can be produced in different wells and is then collected, to a central processing and conditioning site following a minimum of transformations and/or prior treatment, so as to minimize capital and exploitation costs. This amounts to reducing the operations on the production site to what is strictly necessary to ensure that the transportation of the gas by a gas pipeline to the processing site can take place safely. Thus, certain constituents of the natural gas, namely water and acid gases ($CO_2$, $H_2S$) require special precautions.

As water is present in the deposit, the natural gas is saturated with water at the production temperature. During transportation, the gas normally undergoes a pressure drop, which brings about condensation of part of the water, but in certain circumstances this can also give rise to the formation of hydrate crystals, which are inclusion compounds of hydrocarbon molecules in crystalline structures formed by water molecules and which form at a temperature well above 0° C. However, the formation of hydrates in a gas pipeline can lead to blockages and to production stoppages. To avoid this, it is necessary either to dehydrate the gas prior to its transportation, or inject into the gas a hydrate inhibitor such as methanol or ethylene glycol. In the first case, the gas is generally treated in a washing unit by glycol in order to adjust the water dew point to the value imposed for transportation, the latter taking place under single-phase conditions. In the second case, the inhibitor is introduced into the gas just after the well head and transportation takes place at least partially under two-phase conditions.

Most natural gases contain in varying proportions acid gases, i.e. $CO_2$ and/or $H_2S$, which cannot generally be separated at the production site and must therefore be transported with the gas. However, acid gases give rise to corrosion in the pipelines, particularly in the presence of water. Therefore, as from the well head it is necessary to inject corrosion inhibitors into the gas so as to protect the pipes, because in the long term corrosion can give rise to pipe fractures or significant gas leaks. These corrosion inhibitors are injected in trace amounts, but as they are generally expensive products, they contribute to increasing the gas production costs.

On arriving at the processing site, the gas, which may come from several different wells and is collected in the same gas pipeline, is generally dehydrated in order to obtain a water dew point lower than that required for transportation purposes. This second dehydration stage can be performed in most cases either by an absorption of the water in glycol, or by an adsorption of the water on molecular sieves. Thus, this dehydration process can differ from that used at the production site in order to ensure the water dew point necessary for transportation purposes. This second dehydration stage is indispensable if it is wished to be able to cool the gas to a relatively low temperature, which can e.g. be between −10 and −40° C. with a view to extracting therefrom the natural gas liquids, i.e. hydrocarbons other than methane, which can be supplied in liquid form at ambient temperature. Under these conditions the additives which have been injected for transportation purposes (corrosion and hydrate formation inhibitors) are absorbed during the treatment and are not recycled.

The prior art is illustrated by U.S. Pat. Nos. 4,456,067, 3,348,614, and 4,416,333 and in particular FR-A-2 657 416, which describes a contact zone of a natural gas passing out of a well with anti-hydrate and/or anti-corrosion additives located outside said well. The installation of said contact zone in hostile environments, e.g. in the ocean, still causes technical problems which are difficult to solve.

SUMMARY OF THE INVENTION

The process according to the invention relates to a novel use of these anti-hydrate and/or anti-corrosion additives permitting the recycling thereof. Thus, it has been discovered that certain additives (corrosion or hydrate formation inhibitors) can be recovered and recycled to the production well head, which makes it possible to significantly reduce the consumption thereof and therefore reduce the gas production costs. It has also been discovered that during the treatment performed on the gas at the terminal following its transportation, said additives also perform a positive function, which avoids the use of other additives.

In general terms, the process for the treatment and transportation of a natural gas to a reception and treatment terminal comprises the following stages:

a) Under appropriate contacting conditions, contacting takes place with all the gas passing out of at least one production well in a contact area created by at least part of the well and preferably the total depth of said well with a liquid phase at least partly coming from a recycling operation (stage (e) hereinafter) and containing both the water and at least one anti-hydrate additive, said additive being a normally liquid, non-hydrocarbon compound other than water, said compound being at least partly miscible with water and vaporizing in the pure state or in azeotropic form at a temperature below the vaporization temperature of water, so as to obtain an aqueous liquid phase essentially containing no additive, by comparison with said recycled liquid phase, and a gaseous phase, which contains water vapour and substantially all the additive.

b) Said gaseous phase of stage (a) is transported in a pipe to at least one heat exchange area of the terminal.

c) Under adequate conditions, the gaseous phase from stage (b) is cooled in the heat exchange area so as to partly condense it and obtain a non-condensed gas, the condensate incorporating at least one aqueous phase, which contains at least part of said additive.

d) The aqueous phase is separated from the non-condensed gas under appropriate conditions in a separating area and said non-condensed gas is drawn off.

e) The aqueous phase of stage (d) is recycled to stage (a), transporting it in another pipe to the contact area.

The term natural gas is understood to mean gaseous and/or liquid hydrocarbons such as those obtained in condensate gases. The term "normally liquid" compound is understood to mean liquid under normal temperature and pressure conditions.

The advantages of the process according to the invention compared with that of the prior art are that as the contact area is the actual well, there is no need for an external contacting device and the contact area can reach a very considerable height (e.g. 2000 m), which leads to an improved stripping efficiency, which increases as the reservoir temperature rises. Only the gaseous or liquid hydrocarbons are removed from the production well. There is consequently no need to worry about the water, particularly as it can be reintroduced into the reservoir, because it is compatible with the oil water. Consequently there is no danger of precipitations of alkaline earth or alkali metal cations in the reservoir and therefore no blockage or clogging risk.

The weight proportion of anti-hydrate solvent in the water is generally 10 to 90% and preferably 30 to 70%.

According to another embodiment of the invention it is possible to introduce with the anti-hydrate additive and water, at least one non-hydrocarbon, anti-corrosion additive, which is at least partly miscible with water or dispersible in water and which preferably vaporizes at a boiling point below that of the water or which forms with the water an azeotrope, whose boiling point is below that of the water, so that it can be entrained by the gas during stage (a) of the process.

According to this embodiment, the weight proportions in the aqueous liquid mixture are normally 0.1 to 5 and preferably 0.3 to 1% anti-corrosion additive, 10 to 90 and preferably 30 to 70% anti-hydrate additive and 9.9 to 89.9 and preferably 29.7 to 69.7% water.

The aqueous liquid phase proportion introduced into the well generally corresponds to 0.05 to 5% by weight of the gas mass flow rate to be treated and is advantageously 0.1 to 1%. The contacting stage normally takes place at a temperature and a pressure substantially corresponding to that of the gases passing out of the reservoir rock, i.e. that prevailing in the production well, e.g. 20° to 100° C. under 0.1 to 25 MPa.

It is possible to regulate the gas flow rate on the well head in such a way that the injected aqueous liquid phase from the recycling operation flows from top to bottom in countercurrent manner with the gas from the reservoir circulating from bottom to top. This liquid phase preferably flows on the walls of the well.

In order to increase contact efficiency between the liquid phase and the gas, which is already very high due to the length of the contact area, according to a variant of the process, it is possible to place in at least part of the contact area, packing elements such as structured packings or which are constituted by loose elements supported by at least one plate or tray fixed in the well.

The aqueous liquid phase essentially contains no additive, which accumulates at the bottom of the well and can be returned to the reservoir rock.

The invention also relates to the apparatus used for transporting and treating a natural gas and in particular the use of the actual gas well in an apparatus used for the treatment of a natural gas passing out of said well to a reception and treatment terminal. It generally comprises the following cooperating means:

at least preferably vertical well (G1) connecting the pressurized underground natural gas reservoir (R) to at least one well head (T1) able to supply a gaseous phase, means (not shown) for discharging said gas from the reservoir to the well, means (4) for introducing an aqueous liquid phase incorporating at least one additive and connected to means for recycling said liquid phase to the well, preferably upstream of the well head, the upstream of the well head being defined relative to the gas flow direction, means (3, 5) for transporting the pressurized gaseous phase containing water vapour and substantially all the additive, connected to the well head (T1) and to pressurized heat exchange means (E1) of the terminal, means (B1) for separating a liquid aqueous phase from the treated, non-condensed gas and connected to the heat exchange means of said terminal, means (10) for the recovery of the treated, non-condensed gas connected to the separating means (B1), means (8) for drawing off the aqueous phase connected to the separating means and said aqueous phase recycling means (P1, 9, 4) connected to the drawing off means, incorporating a pipe connected to the well (T1), preferably upstream of the well head.

BRIEF DESCRIPTION OF THE DRAWINGS

The invention is described in greater detail hereinafter relative to non-limitative embodiments and the attached drawings, wherein show.

DETAILED DESCRIPTION OF THE DRAWINGS

Figure 1:
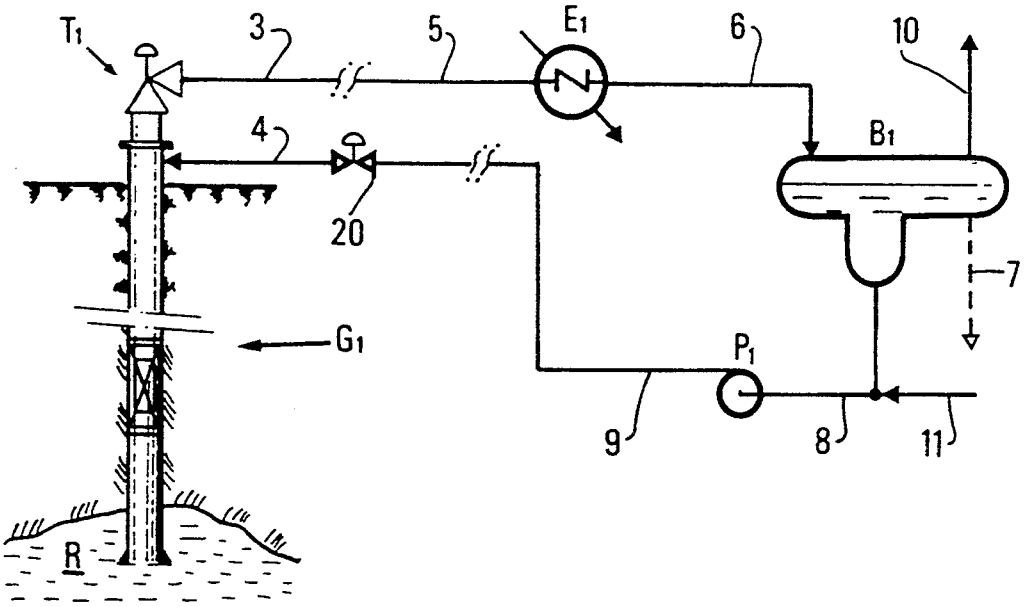
FIG. 1 The apparatus according to the invention.

The principle according to the invention is illustrated by the diagram of FIG. 1 applied in exemplified manner to a natural gas containing methane, the associated higher hydrocarbons, acid gases (carbon dioxide, hydrogen sulphide) and which is saturated with water under the production temperature and pressure conditions. This natural gas comes from a reservoir rock R linked with at least one production well G1, which can be beneath the ocean.

The natural gas rises in the production well G1, whose position is preferably substantially vertical. It is contacted, preferably in countercurrent manner in a contact area G1 created upstream of the well head and which is at least part of the production well, with a mixture constituted by water, at least one hydrate inhibiting solvent either alone or mixed with at least one corrosion inhibiting additive and coming from a pipe 4 provided with a valve 20 and advantageously connected upstream of the well head and preferably in the vicinity thereof. A gaseous phase containing the solvent and additive is discharged at the well head using a nozzle and a pipe 3. At the bottom of the well, the substantially solvent and additive-free aqueous phase returns to the reservoir. The well head gaseous phase is transported in the pipe 3 over a distance which can be several kilometers and arrives in pipe 5 at the reception terminal, where the gas can be treated prior to its dispatch to the commercial network. The gas circulating in the pipe 5 is cooled to the low temperature necessary for treatment in the heat exchanger E1 by a cold-producing fluid external of the process, which brings about a partial condensation. This cooling does not lead to the hydrate formation phenomenon due to the presence of the inhibiting solvent in the gas in a sufficiently high quantity. The cooled mixture passing out of the exchanger E1 through the pipe 6 is constituted by a condensate incorporating an aqueous liquid phase containing most of the water, the solvent and the additive which was in the gas passing out of the contact area G1 through the pipe 3, as well as a heavy hydrocarbon depleted, so-called lean gaseous phase. These two phases are separated in the separating or settling container B1. The lean gas, from which most of the water and heavy hydrocarbons which it contained on entering pipe G1 have been removed, is drawn off by the pipe 10. The aqueous liquid phase is drawn off by the pipe 8 and there is an optional addition of a top-up of solvent and additive circulating in the pipe 11 in order to compensate the losses, taken up by the pump P1 and returned by the pipe 9 to the production site, where it arrives in pipe 4 for recycling.

If the proportion of hydrocarbons heavier than methane is relatively high, during cooling, a liquid hydrocarbon phase forms. In the case illustrated in FIG. 1, this liquid hydrocarbon phase is separated from the aqueous phase in the container B1 and discharged by the pipe 7.

In the process described, the corrosion and hydrate formation phenomena do not occur, because they are inhibited by the presence of the anti-corrosion additive and the anti-hydrate solvent which protect the entire installation. One of the advantages of the process according to the invention is that the anti-hydrate and anti-corrosion additives used are efficient throughout the installation, i.e. the contact area within the well G1, the transportation pipe carrying the gas from the production area to the reception terminal and the processing area during which the natural gas is separated from the water and the heavier hydrocarbons. When a liquid hydrocarbon phase is formed during the cooling stage (c), it is separated from the aqueous phase by settling and is then discharged.

Figure 2:
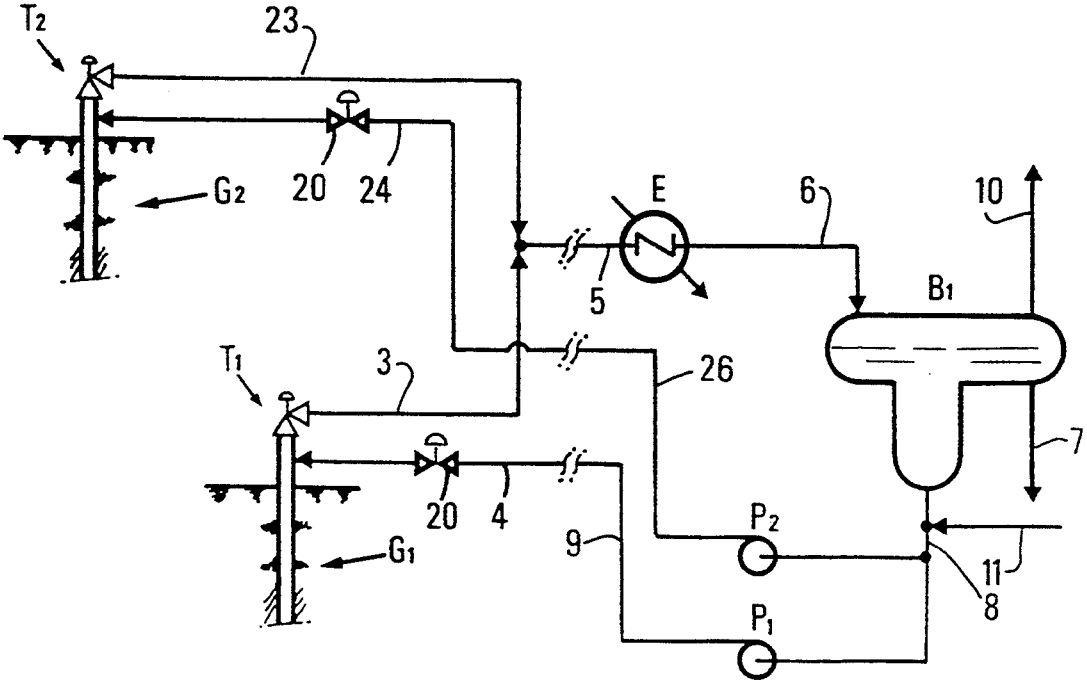
FIG. 2 The presence of several gas wells with the additives according to the invention.

The process according to the invention can apply to the case where natural gas is produced by several wells remote from one another. In this case, at least one of the wells can be used as the contact area G1 and the entire production can be supplied by an appropriate network of pipes to a reception terminal, which will treat the entire gas production. The recycled aqueous liquid phase drawn off by the pipe 8 is then redistributed to the different wells used as contact areas G1. FIG. 2 illustrates the case where two wells are treated by the process according to the invention. In FIG. 2 the equipment the same as that shown in FIG. 1 is designated by the same notations. In this case, the natural gas is produced by two main wells and it is assumed to contain methane, the associated higher hydrocarbons and to be water-saturated under the production pressure and temperature conditions. On the first site, the natural gas passing out of one production well head is treated in the manner described relative to FIG. 1. On the second site, the natural gas rising from another well is treated by contacting in the contact area G2, which is at least part of the well and preferably the entire well, with a mixture constituted by water and hydrate inhibiting solvent from the pipe 24. A solvent-containing gaseous phase is discharged at the head by means of the pipe 23. At the bottom of the well return to the reservoir takes place of an aqueous phase substantially freed from solvent and additive. The head gaseous phase is transported in the pipe 23 and mixed in pipe 5 with the gas from the first production site circulating in the pipe 3. All the gas is transported over a distance which can be several kilometers and arrives by the pipe 5 at the reception terminal, where the gas can be treated prior to passing into the commercial network. The gas circulating in the pipe 5 is cooled to the low temperature necessary for treatment in the heat exchanger E1 by a cold-producing fluid outside the process and which brings about a partial condensation. This cooling does not lead to a hydrate formation phenomenon due to the presence of a sufficiently large quantity of inhibiting solvent in the gas. The cooled mixture passing out of the exchanger E1 by the pipe 6 is constituted by an aqueous liquid phase containing most of the water and the solvent partly located in the gas passing out of the contact area G1 by the pipe 3 and partly in the gas passing out of the contact area G2 by the pipe 23, a liquid hydrocarbon phase constituted by the heavier hydrocarbons of the gas and a so-called lean gaseous phase depleted of heavy hydrocarbons. These three phases are separated in the settling container B1. The lean gas from which most of the water and heavy hydrocarbons which it contained on entering the process have been removed, is drawn off by the pipe 10. The liquid hydrocarbon phase is drawn off by the pipe 7. The aqueous liquid phase is drawn off by the pipe 8 and to it is added make-up solvent top-up in the pipe 11 for compensating losses, and the resultant stream is taken up on the one hand by the pump P1 and returned by the pipe 9 to the first well where it arrives by the pipe 4 for recycling, and on the other hand by the pump P2 and is returned by the pipe 26 to the second well, where it arrives by the pipe 24 for recycling.

Figure 3:
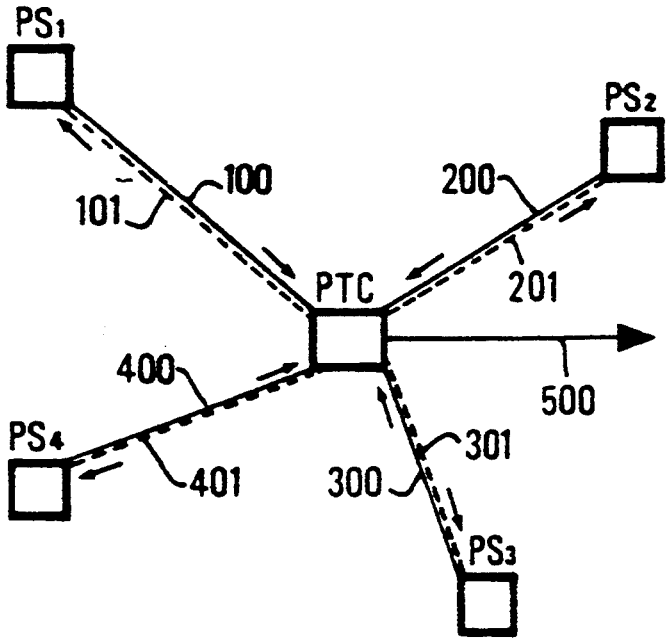
FIG. 3 A production diagram with four wells and a central processing platform.

FIG. 3 shows an exemplified production diagram operating with four remote wells designated respectively PS1, PS2, PS3 and PS4 and which constitute the contact areas. The gas containing solvent, additive and water vapor is passed by the pipes 100 from the well PS1, 200 from the well PS2, 300 from the well PS3 and 400 from the well PS4 to a central platform or processing terminal PTC. On said central processing platform PTC, the gas is cooled in such a way as to obtain an aqueous phase and a partly dehydrated gas, whose water dew point respects the transportation specification imposing on it a value, e.g. equal to or below −10° C. The thus obtained gas is compressed by a compressor placed on the platform PTC and discharged by the pipe 500.

The aqueous phase is returned to the production wells PS1, PS2, PS3 and PS4 by the pumps, which return by the pipes 101, 201, 301 and 401 aqueous phase flows proportional to the gas flows carried by the pipes 100, 200, 300 and 400. At each production well the contact between the gas rising in the well and the recycled aqueous solution makes it possible to add the additive to the gas produced and return to the reservoir at the bottom of the well an aqueous phase substantially free from the additive which is initially contained. On the platform PTC, a periodically replenished additive reserve makes it possible to compensate the additive losses by regular topping up.

The anti-hydrate solvent can advantageously be e.g. methanol. It can also be chosen e.g. from the following solvents: methyl propyl ether, ethyl propyl ether, dipropyl ether, methyl tert. butyl ether, dimethoxymethane, dimethoxyethane, ethanol, methoxyethanol, propanol, used singly or in mixed form.

The anti-corrosion additive can preferably be chosen from among organic compounds of the chemical family of amines, such as diethyl amine, propyl amine, butyl amine, triethyl amine, dipropyl amine, ethyl propyl amine, ethanol amine, cyclohexyl amine, pyrridic morpholine and ethylene diamine, used singly or in mixed form.

At the processing terminal, the cooling temperature necessary for the extraction of the heavier hydrocarbons from the gas is a function of the pressure of the gas and the desired recovery level. It can e.g. be between +10 and −60° C. and preferably between −10 and −40° C. for a gas pressure e.g. between 0.1 and 25 MPa and preferably between 0.2 and 10 MPa. This cooling can be obtained either by an external cooling cycle, or by other means such as e.g. expansion of the gas in a turbine or an expansion valve.

The dehydrated gas passing out of the cooling stage (c) can undergo a complementary treatment. It may in particular be necessary to at least partly eliminate the acid gases contained therein. In this case, it is advantageous to use the same solvent as that used for inhibiting the formation of hydrates, e.g. methanol, at low temperature, whilst carrying out countercurrent washing of the gas in a packed or plate column. The solvent passing out of the washing area can then be regenerated by lowering the pressure and/or heating, followed by recycling. The gas which is dehydrated and deacidified at least partly is then drawn off.

Different known equipment items can be used for carrying out the various stages of the process.

Any other known device making it possible to bring about such a contact between the liquid phase and the gaseous phase can also be used. Such a device can e.g. be constituted by a centrifugal contactor introduced into the well in which the countercurrent flow of the two phases takes place no longer under the effect of gravity, but under the effect of a centrifugal force, with a view to obtaining a phase separating device.

The process according to the invention is illustrated by the following example.

EXAMPLE 1

This example follows the diagram of FIG. 1. A natural gas is produced on a site and passes through the vertical well over a total height of 1000 metres. Its pressure is 7.5 MPa (abs) and its temperature in the well is 80° C. Its composition is given in table 1 and it is saturated with water. Its flow rate is 12.3 tons/h, which corresponds to 0.35 million normal cubic meters daily.

TABLE 1

| CONSTITUENT | % by weight |
|---|---|
| $CO_2$ | 5.1 |
| methane | 76.2 |
| ethane | 8.2 |
| propane | 5.6 |
| isobutane | 1.1 |
| N-butane | 2.1 |
| isopentane | 0.6 |
| N-pentane | 0.6 |
| $C_6$+ | 0.5 |

Within the contact area G1 inside the vertical well, it is contacted with 157 kg/h of a mixture constituted by water, 49.2% by weight methanol as the hydrate inhibiting solvent and 0.5% by weight of triethyl amine as the corrosion inhibiting additive and coming from pipe 4. At the head and using the pipe 3 evacuation takes place of water vapour, methanol and triethyl amine. At the bottom, to the reservoir is returned an aqueous phase with a flow rate of 77.7 kg/h and containing less than 0.1% by weight methanol and a non-detectable triethyl amine quantity. The well head gaseous phase is transported in the pipe 3, which is a 0.09 meter diameter under water gas pipeline, over a distance of 11.2 km and it arrives by the pipe 5 at the reception terminal, where its pressure is 6.95 MPa as a result of the pressure drop in the pipeline. The gas is cooled to a temperature of −15° C. in the heat exchanger E1 by means of a cold-producing fluid which is outside the process and is e.g. constituted by propane at 25° C. This cooling brings about a partial condensation of the gas. The cooled mixture passing out of the exchanger E1 by the pipe 6 is constituted by non-condensed gas and on the one hand 155.1 kg/h of an aqueous liquid phase of a mixture of water, methanol and triethyl amine and on the other 41 kg/h of a liquid hydrocarbon phase. These three phases are separated in the settling container B1 at a pressure substantially equal to the reception pressure at the terminal. The uncondensed gas is drawn off by the pipe 10. The liquid hydrocarbon phase is drawn off by the pipe 7 and is recovered. The aqueous liquid phase is drawn off by the pipe 8 and to it is added a make-up constituted by 1.9 kg/h of methanol and 0.002 kg/h of triethyl amine and circulating in the pipe 11; the resultant stream is taken up by the pump P1 and returned under a pressure of 8.0 MPa by the pipe 9 located along the under water gas pipeline to the production site, where it arrives by the pipe 4 for recycling upstream of the well head.

We claim:

1. A process for the treatment and transportation of natural gas coming from at least one production well embedded in a reservoir rock and connected to a reception and processing terminal, said process comprising the following stages:

(a) in a contact zone, contacting the natural gas with a liquid phase at least partly coming from a recycling operation (stage (e) hereinafter) and containing both water and at least one anti-hydrate additive, said additive being a non-hydrocarbon compound, which is normally liquid, other than water, said compound being at least partly miscible with water, and vaporizing in said anti-hydrate additive in the pure state or as an azeotrope at a temperature below the vaporization temperature of the water, so as to obtain a liquid aqueous phase containing substantially no additive by comparison with said recycled liquid phase, and a gaseous phase containing production natural gas, water vapor, and substantially all the additive;

(b) transporting said gaseous phase of stage (a) in a pipe to at least one heat exchange zone of said terminal;

(c) cooling and partially condensing the gaseous phase from stage (b) in the heat exchange zone to obtain a non-condensed gas and a condensate containing an aqueous phase which contains at least part of said additive;

(d) separating the condensate containing the aqueous phase from the non-condensed gas in a separating zone and withdrawing said non-condensed gas; and (e) recycling at least part of the aqueous phase of stage (d) to stage (a), characterized in that the contact zone comprises at least part of the production well.

2. A process according to claim 1, wherein the weight proportion of the anti-hydrate additive in the recycled liquid phase is 10 to 90%.

3. A process according to claim 1, wherein the recycled liquid stage also contains at least one anti-corrosion additive, which is a normally liquid, non-hydrocarbon compound, other than water, said compound being at least partly miscible with water or dispersible in water and which vaporizes in the pure state or in the form of an azeotrope at a temperature below the vaporization temperature of the water and wherein the weight proportions in the recycled liquid phase are 0.1 to 5 anti-corrosion additive and 10 to 90% anti-hydrate additive and.

4. A process according to claim 1, wherein, according to stage (a) the proportion of recycled liquid phase with respect to the mass flow rate of gas passing out of the well is 0.05 to 5% by weight the temperature being substantially between 20° and 100° C. and the pressure between 0.1 and 25 MPa.

5. A process according to claim 1, the condensate in stage (c) comprises an aqueous phase and a liquid hydrocarbon phase, and further comprising separating the hydrocarbon phase from the aqueous phase by settling during stage (d), and withdrawing said liquid hydrocarbon phase from stage (d).

6. A process according to claim 1, wherein said production gas is produced by at least two different wells, performing stage (a) in at least one well, and mixing resultant gaseous phases passing out of the wells prior to undergoing stage (b).

7. A process according to claim 1, wherein the anti-hydrate additive is at least one compound selected from the group consisting of methanol, methyl propyl ether, dimethoxymethane, dimethoxyethane, ethanol, methoxyethanol and propanol, and the anti-corrosion additive is at least one compound selected from the group consisting of diethyl amine, propyl amine, butyl amine, triethyl amine, dipropyl amine, ethyl propyl amine, ethanol amine, cyclohexyl amine, pyrridic morpholine and ethylene diamine.

8. A process according to claim 1, wherein the cooling temperature of stage (c) is between +10° and −60° C.

9. A process according to claim 1, wherein stage (a) is performed under the ocean, and transporting the gas during stage (b) by an underwater pipeline.

10. A process according to claim 1, further comprising subjecting the gas passing out of stage (d) to a complementary cold scrubbing step with the solvent used as the additive in stage (a), so as to eliminate at least part of the acid gases contained in said gas.

11. A process according to claim 1, wherein said contacting occurs at least partially in packing elements situated in at least part of the depth of the well.

12. A process according to claim 1, further comprising returning the liquid aqueous phase of stage (a) into the reservoir rock.

13. A process according to claim 10, wherein at least part of the contact zone contains packing elements.

14. A process according to claim 1, wherein the contact zone comprises the total depth of the well.

15. A process according to claim 2, wherein the weight proportion is 30–70%.

16. A process according to claim 3, wherein the weight proportion of anti-corrosion additive is 0.3–1%, and the weight proportion of anti-hydrate additive is 30–70%.

17. A process according to claim 4, wherein the proportion is 0.1–1% by weight.

18. A process according to claim 8, wherein the cooling temperature is between −10° and −40° C.

19. A process according to claim 6, wherin stage (a) is performed in less than all of the different production wells.

* * * * *